United States Patent [19]

Owen et al.

[11] 4,077,866

[45] Mar. 7, 1978

[54] PROCESS FOR PRODUCING LOW-SULFUR LIQUID AND SOLID FUELS FROM COAL

[75] Inventors: Hartley Owen, Belle Mead; Paul B. Venuto, Cherry Hill, both of N.J.; Tsoung-Yuan Yan, Philadelphia, Pa.

[73] Assignee: Mobil Oil Corporation, New York, N.Y.

[21] Appl. No.: 728,660

[22] Filed: Oct. 1, 1976

[51] Int. Cl.[2] ..... C10G 1/04

[52] U.S. Cl. ..... 208/9; 208/8; 208/106

[58] Field of Search ..... 208/10, 8, 9, 106

[56] References Cited

U.S. PATENT DOCUMENTS

| | | | |
|---|---|---|---|
| 3,502,564 | 3/1970 | Hodgson | 208/9 |
| 3,519,553 | 7/1970 | Johanson et al. | 208/10 |
| 3,527,691 | 9/1970 | Hodgson | 208/10 |
| 3,642,608 | 2/1972 | Roach et al. | 208/8 |
| 3,728,252 | 4/1973 | Pitchford | 208/9 |
| 3,813,329 | 5/1974 | Gatsis | 208/10 |
| 3,840,456 | 10/1974 | Yavorsky et al. | 208/10 |
| 3,856,675 | 12/1974 | Sze et al. | 208/8 |
| 3,923,634 | 12/1975 | Silvestri et al. | 208/10 |
| 3,930,984 | 1/1976 | Pitchford | 208/10 |

FOREIGN PATENT DOCUMENTS

| | | | |
|---|---|---|---|
| 2,444,827 | 8/1976 | Germany | 208/10 |

*Primary Examiner*—Delbert E. Gantz
*Assistant Examiner*—James W. Hellwege
*Attorney, Agent, or Firm*—Charles A. Huggett; Carl D. Farnsworth

[57] ABSTRACT

An improved process for the conversion of coal to low-sulfur products is disclosed wherein coal is heated with a liquid phase coal dissolution solvent, which is preferably a heavy aromatic petroleum solvent, in the presence of a solid, sulfur scavenger such as iron. Improved separation of inorganic solids, including both coal-derived and solvent-derived sulfur combined with the scavenger, is obtained by using a light cycle-oil modified slurry settler operation followed by separation. Vacuum distillation of the filtrate provides a low-sulfur solid which is used directly as fuel or coked to form low-sulfur distillates and coke. The scavenger is separated from other inorganics, regenerated, and recycled. Moderate amounts of fuel gas are also formed.

10 Claims, 2 Drawing Figures

HCO
HEAVY OIL
LOW "S" SRC
COKE
COKER
VACUUM TOWER
HEAT
GAS
GASOLINE
LFO
HFO
LCO
STG
MAIN COLUMN
REACTOR DISSOLVER
SLURRY SETTLER
SEPARATOR
FCC
MCB STG
COAL PREPARATION
IRON PREPARATION
IRON REJECT
COAL
IRON MAKEUP
ASH SOLIDS
STEAM
FUEL GAS
GAS PLANT DESULFURIZATION
REGENERATIVE GASIFIER
AIR

PROCESS FOR PRODUCING LOW-SULFUR LIQUID AND SOLID FUELS FROM COAL

BACKGROUND OF THE INVENTION

1. Field of the Invention

This invention relates to the conversion of solid carbonaceous materials to low-sulfur liquid and solid fuels and is particularly concerned with an improved coal conversion process wherein: (1) dissolution of coal in a coal dissolution solvent is carried out in the presence of an inorganic solid sulfur scavenger and (2) separation of undissolved solids from the solvent/coal extract mixture is achieved by the use of a slurry settler operation prior to other separation means, such as filtration.

2. Description of the Prior Art

Coal constitutes the largest single fossil fuel source of the United States. Nevertheless, its use has been restricted because of environmental regulations and the availability of petroleum and natural gas as alternative sources of energy. However, to achieve the national goal of energy self-sufficiency it is now apparent that coal must play a major role in meeting our expanding energy requirements. A principal drawback to the use of coals found in the United States is their sulfur content which can range up to 5 percent or more; large quantities of sulfur compounds, which are known to be environmentally hazardous, are discharged when unconverted coal is burned to produce energy. Known processes for converting coal to clean liquid or solid fuels may be generally classified as:

(1) aqueous leaching processes;
(2) solvent refining processes;
(3) catalytic hydrogenation processes;
(4) Fischer-Tropsch and related synthesis processes, and
(5) pyrolytic or carbonization processes.

Catalytic hydrogenation processes involve hydrogenation to liquids by using temperatures, pressures, and contact times sufficiently severe to convert the majority of the coal to a material which is liquid at ambient temperatures. Ash is separated from the liquid by a suitable filtration or centrifugation operation. Hydrogen requirements are higher than for solvent refining and catalysts are generally employed to accelerate the reaction. Because processes of this type are not specifically related to the present invention, this category of coal conversion processes is not further discussed herein.

Similarly, Fischer-Tropsch syntheses processes (wherein hydrogen and carbon monoxide produced from coal are recombined over a suitable catalyst to produce liquid fuels) and pyrolytic processes (wherein coal is treated in an inert atmosphere or in the presence of reactants for selective volatilization of sulfur and other impurities) are not specifically related to the present invention and, therefore, are not discussed further. However, both aqueous leaching processes and solvent refining processes are relevant in the context of the present invention and will be treated in more detail below.

The classification of coal conversion processes referred to as "aqueous leaching processes" involve treatment of coal with an aqueous solvent to preferentially leach out harmful pollutants, such as sulfur and ash, and leave a relatively clean, solid carbonaceous residue. Exemplary of such processes are U.S. Pat. Nos. 3,768,988; 3,864,223; 3,917,465, 3,926,575, and 3,960,513. These processes, sometimes referred to generically as the "Meyer's Process," basically involve removal of iron pyrites from coal by aqueous solutions of ferric ions.

Although the coal treated by a leaching process is usually in solid, particulate form, it is not necessarily required. For example, U.S. Pat. No. 2,221,866 teaches the desulfurization of a coal extract which has been separated from undissolved residue following the dissolution of the coal in a liquid solvent medium. According to that process, the separated, liquid extract is washed with an alkali solution under pressure, at a temperature above 150° C, and in the presence of an oxide of aluminum or of a heavy metal or with a substance or substances capable of giving rise to such an oxide when heated. This treatment is asserted to have the advantage of removing significantly more organic sulfur from the coal than the Meyer's Process. For the purpose of considering the present invention, it should be noted that the disclosure of U.S. Pat. No. 2,221,866 is limited to the treatment of coal extract previously separated from the undissolved residue of the coal dissolution step.

U.S. Pat. No. 3,909,211 discloses a process wherein comminuted coal is treated with $NO_2$ gas prior to washing with water or a heated alkali metal hydroxide solution. The $NO_2$ pretreatment oxidizes the sulfur organically bound in the coal to produce a sulfur containing product capable of easier removal in the subsequent aqueous leaching step. Again, the process has the advantage over the Meyer's Process of removing a greater amount of the sulfur which is organically bound in the coal.

The second classification of known processes for converting coal to clean liquid or solid fuels is a solvent refining process which consists of heating coal in an organic solvent, often in the presence of hydrogen, to a temperature just sufficient to dissolve most of the organic material in the coal. Following this solvent treatment, the products are separated to yield a high-boiling extract containing liquid hydrocarbons derived from the coal and a solid phase composed of insoluble coal residues. The insoluble coal residues are sometimes only partially separated from the residue to permit the recovery of the residue in the form of a flowable slurry. The extract may then be recovered as a relatively low-ash, low-sulfur product resembling asphalt in appearance or, alternatively, the extract may then be subjected to catalytic cracking or other refining operations for conversion of the high boiling material into lower boiling hydrocarbons. The solids separated from the extract are generally subjected to a low-temperature carbonization treatment for the production of additional liquid products and char useful as fuel. Processes which are exemplary of solvent refining processes are disclosed in U.S. Pat. Nos. 3,518,182; 3,520,794; 3,523,886; 3,748,254; 3,841,991, and 3,920,418.

The fundamental reaction of the solvent refining processes is the depolymerization and solution of a major portion of the coal in a hydrogen-donor solvent (usually having an aromatic composition) as a result of hydrogen transfer to the coal from the donor solvent. Subsequent steps separate the reaction products and recover solvent from the extract and from the solid residue.

The separation of undissolved coal residue and ash from the solvent-extract solution is a most critical step in preparing clean fuels from coal by the solvent refining process, particularly in processes wherein the extract from the separation is passed to a catalytic hydrocracker for upgrading. In such a process, extremely small solids (for example, 10 microns and less) remaining in the clarified liquid can block catalyst pores and eventually cause channeling in the catalyst bed. Therefore, it is important that these extremely small particles be removed from the liquid extract, not only to enhance immediate product purity but to improve downstream processing of the immediate product. However, the solids separation problem is complicated by the fact that the solids are very fine and tacky. Furthermore, the liquid must be handled at high temperatures to avoid precipitation of high molecular weight asphaltenes which form a separate, gelatinous, liquid phase.

U.S. Pat. No. 3,790,467 discloses a solvent refining process separation step wherein a coal extract liquid derived from the coal liquefaction product and containing at least 20 volume percent of materials boiling below about 400° F or at least 20 volume percent of materials boiling above about 1000° F is added to the coal liquefaction product prior to separation. The addition of the coal extract liquid having the foregoing properties is an amount sufficient to make at least a portion of the smaller, more difficultly separable solids in the coal liquefaction product combine to form solids that are larger and more easily separable in the separation zone. Of course, the effectiveness of the inventive process assumes that solids size is a parameter of the means employed in the separation step. Essentially, the inventive concept of the patent disclosure is that "quasi-solid" coal extract materials liquefied in a deep extraction of the coal are "cast from solution" by the coal extract liquid and resolidify on the surface of the smaller, more difficultly separable solids in the coal liquefaction product — in other words, the solids serve as nuclei for the precipitating "quasi-solid" material.

While this process is effective in increasing the quantity of ash removed in a process employing centrifugation as a separation means, it is desirable that more economical methods be developed for improving the removal of solids from coal extracts produced in the coal dissolution step of solvent refining processes. Moreover, while the process of U.S. Pat. No. 3,790,467 may increase the overall sulfur removal by incidentally removing a greater amount of sulfur-containing solids, it is also desirable to develop processes which incorporate desulfurization and deashing of solid carbonaceous fuels in one integrated operation so that equipment and energy needs for the process may be minimized.

SUMMARY OF THE INVENTION

This invention provides an improved solvent refining process for the conversion of coal to liquid and solid fuels which comprises, in its broadest aspects, the following essential steps:

1. subjecting a finely divided coal to treatment with a solvent and an inorganic, solid sulfur scavenger without added hydrogen at a temperature sufficient to dissolve substantially all the organic material in the coal; and
2. partially separating the total extraction effluent in a slurry settler operation to produce a clarified extract/solvent overflow and a solids-containing underflow.

The clarified extract/solvent overflow from the slurry settling step may be further processed by any of the methods practiced in the art of solvent refining of coal, including distillation, coking, cracking of separated coal extract fractions, etc. Similarly, the solids-containing underflow may be further treated by methods taught in the art. However, in a preferred embodiment of this invention, the underflow from the slurry settler is subjected to a subsequent solid-fluid separation by such means as filtration, centrifugation, multicloning, etc. The solid sulfur scavenger may then be efficiently recovered from the solids-containing stream produced in this subsequent separation step by regenerative gasification of the solids-containing stream to remove hydrocarbon values and sulfur, followed by separation of the scavenger from the remaining solid residue by means suited to the properties of the particular scavenger employed.

The dissolution solvent may be any of the hydrogen-donor solvents which are extensively discussed in the prior art. However, the use of highly refractory aromatic petroleum solvents is preferred, particularly sulfur- and solids-containing aromatic solvents derived from the catalytic cracking of petroleum. The unique advantages of the present invention are particularly valuable in such an aspect of this invention because the solid, sulfur scavenger employed in the dissolution step will result in desulfurization of both the coal and sulfur-containing solvent. Moreover, the slurry settling step of this invention efficiently removes solids contained in the total extraction effluent which are derived from both the coal and the solids-containing solvent. Catalyst fines and other solid impurities are also efficiently removed from the solvent in the process, and therefore, prior separation steps to improve solvent quality in terms of sulfur and insoluble solids content are surplusage. Thus, substantial savings in terms of both equipment and energy requirements for the over-all processing of coal and petroleum to clean fuel products result. Furthermore, viewing this aspect of the invention as part of an integrated process for the treatment of coal and petroleum, an efficient method of augmenting the supply of heavy fuels from petroleum refining operations is achieved since coal is incorporated into the refining operation with minimum additional process requirements. The product of the incorporation is a low-sulfur, low ash, heavy fuel suitable either for outside marketing to the public or, in the event of fuel emergencies or legislative pressures, for use in supplying the refiner's internal energy needs.

For a better understanding of the present invention, its objects and advantages, reference should be had to the following description in which preferred embodiments thereof are described.

DESCRIPTION OF THE PREFERRED EMBODIMENTS

Figure 1:
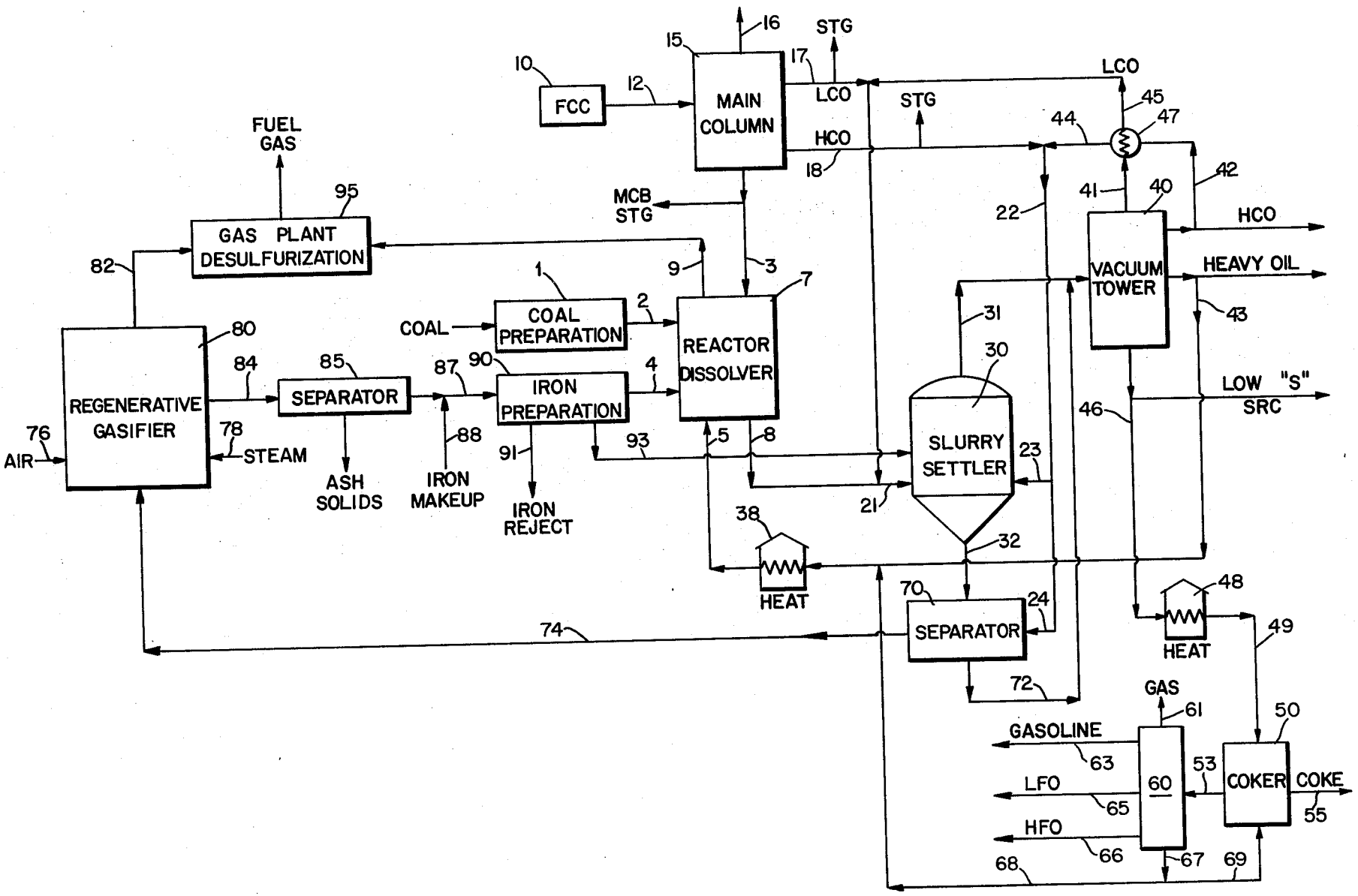
FIG. 1 is a flow diagram of a preferred embodiment of the improved solvent refining process of this invention.

Any solid carbonaceous material may be employed as "coal" in the process of this invention including natural coals such as high- and low-volatile bituminous, lignite, brown coal, etc., or solvent-refined coal or related "modified" coal. The coal may be high-ash, high-metals, high-sulfur, and have poor caking characteristics, and still be quite suitable for this process scheme. The process scheme is particularly useful in removing the last, most difficult-to-remove sulfur in order to meet combustion specifications in natural coals or solvent-refined coals. Typical analyses of various coals suitable for use are as follows:

| | |
|---|---|
| **High Volatile A** | |
| Sulfur | 1.33% |
| Nitrogen | 1.63 |
| Oxygen | 7.79 |
| Carbon | 80.88 |
| Hydrogen | 5.33 |
| Ash | 2.77 |
| **Sub-Bituminous** | |
| Sulfur | 0.21% |
| Nitrogen | 0.88 |
| Oxygen | 15.60 |
| Carbon | 65.53 |
| Hydrogen | 5.70 |
| Ash | 3.99 |
| **Lignite** | |
| Sulfur | 0.53% |
| Nitrogen | 0.74 |
| Oxygen | 32.04 |
| Carbon | 54.38 |
| Hydrogen | 5.42 |
| Ash | 5.78 |

Although "coal" is the principal material to be converted by the solvent refining process of this invention, it need not be the only solid carbonaceous material converted. For example, from about 1 to 25 weight percent of materials such as municipal refuse, rubber (either natural or synthetic), cellulosic wastes, and other waste polymers which heretofore have been buried, burned, or otherwise disposed of may be added to the "coal" feed. The addition of such materials to this process increases the yield of valuable fuel products from low-cost, relatively available material otherwise requiring disposal.

The sulfur scavenger employed may be any material with an affinity for sulfur in organic moieties derived from coal or in petroleum fractions. It is essential that the sulfur scavenger be precipitable, or capable of separation from a liquid medium by sedimentation, settling, multicloning, centrifugation, filtration or other density-related fluid/solid separation techniques. Any inorganic, organic or organometallic element or compound capable of conversion to an insoluble sulfide or sulfur complex and/or capable of removing or displacing organic sulfur as a volatile sulfur compound may be used in this process. However, iron and iron oxides (particularly $Fe_2O_3$) are preferred because of potential low cost and ease of availability. For example, the iron could be easily obtained from scrap iron, tramp iron, etc. Nevertheless, other metals, metal oxides, and metal salts are also suitable sulfur scavengers. An exemplary but not exhaustive list of such materials includes Co, Co-oxides, Ni, Ni-oxides, Mo, Mo-oxides, Zn, Zn-oxides, Sn, Sn-oxides, Sb, Sb-oxides, Pb, Pb-oxides, As, Bi, Bi-oxides, Cd, and Cd-oxides. Other suitable scavenger materials are zeolites, crystalline aluminosilicates, phosphates, heteropolyacids, manganese nodules, hopcalite, etc.

Included within the scope of the term "coal liquefaction solvent" as used herein are all solvents employed in the coal liquefaction step of solvent refining processes known in the art of coal conversion. Polycyclic, aromatic hydrocarbons which are liquid at the temperature and pressure of the extraction are generally recognized to be suitable solvents for the coal in the liquefaction step. At least a portion of the aromatics may be partially or completely hydrogenated, whereby some hydrogen transfer from solvent to coal may occur to assist in the breakdown of large coal molecules. Mixtures of the hydrocarbons are often used and these may be derived from subsequent steps in the process of this invention. Other types of coal solvent, such as oxygenated aromatic compounds, may be added for special reasons, for example, to improve the solvent power, but the resulting mixture should be predominantly of the type mentioned.

Preferred solvents suitable for the practice of this invention are thermally stable, highly polycyclic aromatic mixtures which result from one or more petroleum refining operations. By the term "thermally stable" refinery petroleum fractions is meant a high boiling residuum which contains a substantial proportion of polycyclic, aromatic hydrocarbon constituents such as napthalene, dimethylnaphthalene, anthracene, phenanthrene, fluorene, chrysene, pyrene, perylene, diphenyl, benzothiophene, and the like. Such refractory petroleum media are resistant to conversion to lower molecular products by conventional non-hydrogenative procedures. Typically, these petroleum refinery residual and recycle fractions are hydrocarbonaceous mixtures having an average carbon to hydrogen ratio above about 1:1, and a boiling point above about 450° F. Representative heavy petroleum solvents include FCC bottoms; syntower bottoms; asphaltic material; alkane-deasphalted tar; coker gas oil; heavy cycle oil; clarified slurry oil; mixtures thereof, and the like.

A highly preferred solvent for use in the invention is an FCC main column bottoms fraction which is obtained from the catalytic cracking of gas oil in the presence of a solid porous catalyst. This bottoms fraction is recovered as a slurry containing a suspension of catalyst fines. The "slurry oil" is directly suitable for use as a liquefaction solvent in the invention process, or it can be subjected to further treatment to yield a "clarified slurry oil". The further treatment can involve introducing the hot slurry oil into a slurry settler unit in which it is contacted with cold heavy cycle oil to facilitate settling of catalyst fines out of the slurry oil. The overhead liquid effluent from the slurry settler unit is the said "clarified slurry oil". A more detailed description of the production and recovery of FCC main tower bottoms is disclosed in U.S. Pat. No. 3,725,240.

A typical clarified slurry oil has the following mass spectrometric analyses and properties:

| Elemental Analysis, Wt. % | | | |
|---|---|---|---|
| C | 89.93 | Pour Point, ° F: | 50 |
| H | 7.35 | CCR, %: | 9.96 |
| O | 0.99 | Distillation: | |
| N | 0.44 | IBP, ° F: 490 | |
| S | 1.09 | 5%, ° F: 640 | |
| Total | 99.80 | 95%, ° F: 905 | |

A typical FCC main column bottoms contains a mixture of chemical constituents as represented in the following mass spectrometric analysis:

| Compounds | Wt.% Aromatics | Wt.% Naphthenic-Aromatics | Labile $H_2$% |
|---|---|---|---|
| Alkyl-Benzenes | 0.4 | | 0 |
| Naphthene-Benzenes | | 1.0 | 0.03 |

-continued

| Compounds | Wt.% Aromatics | Wt.% Naphthenic-Aromatics | Labile $H_2$% |
|---|---|---|---|
| Dinaphthene-Benzenes | | 3.7 | 0.16 |
| Naphthalenes | 0.1 | | 0 |
| Acenaphthenes, (biphenyls) | | 7.4 | 0.08 |
| Fluorenes | | 10.1 | 0.11 |
| Phenanthrenes | 13.1 | | |
| Naphthene-phenanthrenes | | 11.0 | 0.18 |
| Pyrenes, fluoranthenes | 20.5 | | 0 |
| Chrysenes | 10.4 | | 0 |
| Benzofluoranthenes | 6.9 | | 0 |
| Perylenes | 5.2 | | 0 |
| Benzothiophenes | 2.4 | | |
| Dibenzothiophenes | 5.4 | | |
| Naphthobenzothiophenes | | 2.4 | 0.04 |
| Total | 64.4 | 35.6 | 0.60 |

A FCC main column bottoms is an excellent liquefaction solvent medium for coal solubilization because it has a unique combination of physical properties and chemical constituency. A critical aspect of solvating ability is the particular proportions of aromatic and naphthenic and parrifinic moieties characteristic of a prospective coal liquefaction solvent. A high content of aromatic and naphthenic structures (e.g., labile hydrogen) in a solvent is a criterion for high solvating ability for coal liquefaction.

The solvating ability of a coal liquefaction solvent can be expressed more conveniently in terms of specific types of hydrogen content as determined by proton nuclear magnetic resonance spectral analysis. Nuclear magnetic resonance characterization of heavy hydrocarbon oils is well developed. The spectra (60μ c/sec) are divided into four bonds ($H_\alpha$, $H_\beta$, $H_\gamma$ and $H_{Ar}$) according to the following frequencies in Hertz (Hz) and chemical shift (δ):

| | $H_\alpha$ | $H_\beta$ | $H_\gamma$ | $H_{Ar}$ |
|---|---|---|---|---|
| Hz | 0–60 | 60–100 | 120–200 | 360–560 |
| δ | 0–1.0 | 1.0–1.8 | 2.0–3.3 | 6.0–9.2 |

The $H_{Ar}$ protons are attached to aromatic rings and are a measure of aromaticity of a solvent. $H_\alpha$ protons are attached to non-aromatic carbon atoms attached directly to an aromatic ring structure, e.g., alkyl groups and naphthenic ring structures. $H_\beta$ protons are attached to carbon atoms which are in a second position away from an aromatic ring, and $H_\gamma$ protons are attached to carbon atoms which are in a third position or more away from an aromatic ring structure.

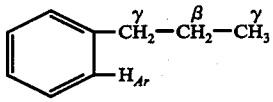

The $H_{Ar}$ protons are important because of their strong solvency power. A high content of $H_\alpha$ protons is particularly significant in a liquefaction solvent, because $H_\alpha$ protons are labile and are potential hydrogen donors in a coal liquefaction process. $H_\beta$ and $H_\gamma$ protons are paraffinic in nature and do not contribute to the solvating ability of a coal liquefaction solvent.

The proton distribution in various highly aromatic hydrocarbon by-product streams are represented as follows:

| | $H_\alpha$ | $H_\beta$ | $H_\gamma$ | $H_{Ar}$ | $H_\alpha/H_\beta$ |
|---|---|---|---|---|---|
| Torrance FCC/MCB | 36.0 | 19.3 | 12.7 | 32.0 | 1.87 |
| Augusta TCC/MCB | 29.8 | 20.9 | 7.9 | 41.4 | 1.42 |
| Paulsboro TCC/MCB | 16.3 | 48.1 | 20.0 | 15.6 | 0.35 |
| Agha Jari Resid (850+) | 12.0 | 60.0 | 24.0 | 5.0 | 0.20 |
| Durban FCC/MCB | 36.4 | 13.6 | 5.2 | 44.8 | 2.68 |
| SRC* Recycle Oil | 27.1 | 14.7 | 6.9 | 46.3 | 1.84 |
| Coal Tar | 5. | — | — | 91. | — |

*Solvent refined coal

It is particularly preferred that the FCC main column bottoms employed as a coal liquefaction solvent in the present invention process has a hydrogen content distribution in which the $H_{Ar}$ proton content is between about 30 and 50 percent, the $H_\alpha$ proton content is at least about 30 percent, and the $H_\alpha/H_\beta$ proton ratio is above about 1.4. Concomitantly it is desirable that the $H_\alpha$ proton content is below 20 percent and the $H_\gamma$ proton content is below 13 percent.

Referring now to FIG. 1 which illustrates a preferred embodiment of the present invention, coal — especially high-sulfur, high-ash coal — is first pulverized in the coal preparation unit 1 before being passed through line 2 to reactor-dissolver 7 as prepared coal. Ball mills or other types of conventional apparatus may be employed for pulverizing coarse coal in the coal preparation unit. The crushing and grinding of the coal can be accomplished either in a dry state or in the presence of the coal liquefaction solvent employed in the reactor-dissolver. In the illustrated preferred embodiment, crushing and grinding of the coal in the presence of the coal liquefaction solvent would be accomplished by diverting a suitable portion of the FCC main column bottoms (MCB), entering the reactor dissolver 7 through line 3, to the coal preparation step. The average particle diameter of the feed coal is below about 0.5 inch and preferably below about 0.1 inch.

Coal liquefaction solvent employed in this embodiment is a fraction of the stream produced in the fluid catalytic conversion (FCC) process 10, a well-known petroleum refining operation wherein gas oil is catalytically cracked in the presence of a solid, porous catalyst. The product stream from the fluid catalytic conversion process 10 is passed through line 12 to the main column 15, an atmospheric distillation process which separates the product into an overhead fraction 16, a main column light cycle oil (LCO) fraction 17, a main column heavy cycle oil (HCO) fraction 18 and a residuary fraction referred to as FCC main column bottoms (MCB) which is removed from the main column 15 through line 3 and either sent to storage (STG) or used immediately as the coal dissolution solvent in the reactor-dissolver 7.

Prepared coal passes through line 2 to reactor-dissolver 7 where it is mixed with MCB solvent entering through line 3, and a solid, sulfur scavenger entering through line 4. The preferred sulfur scavenger is selected from the group consisting of iron, iron oxide, comminuted scrap iron and rust scale. The coal, MCB solvent and solid sulfur scavenger are maintained in intimate contact without added hydrogen gas at an elevated temperature for a time sufficient to dissolve most of the organic material in the coal; i.e., up to about 80 weight percent of the MAF feed coal will be converted, e.g., depolymerized, hydrogenated, dissolved, etc.

The reactor-dissolver 7 may have any of the design configurations commonly known to those skilled in the art; including, for example, continuous-flow tubular reactor, batch or continuous-flow stirred tank, and staged design configurations. The coal dissolution process in the reactor is generally conducted at a temperature in the range of 500° to 1000° F, a pressure in the range of 0 to 2000 psig, a residence time in the range of 10 seconds to 5 hours, and solvent-to-coal ratio of 0.5 to 10.0. Preferred solvent to coal ratios are in the range from 2 to 4. Residence times are a function of temperature for a given set of process equipment. In general it may be stated that the higher the temperature, the lower the residence time. Pressure is not a major variable since the process is performed without externally-added hydrogen gas. Hence, the pressure of the reactor-dissolver can be atmospheric, elevated, or autogenous as developed in the reactor-dissolver.

The ratio of sulfur scavenger to coal may vary widely ranging from 1 part by weight of scavenger to 5 to 50 parts of coal. In general it may be stated that the scavenger to coal ratio is proportional to the quantity of organic sulfur in the coal and in the coal dissolution solvent. Note that the ratio is not a function of the pyritic sulfur content of the coal. This is so because the iron sulfur scavenger selectively removes organic sulfur from the coal but has relatively little effect on the pyritic sulfur; removal of pyritic sulfur is instead achieved downstream in the slurry settler operation 30. As shown in the example, suitable Fe:coal ratios in the order of 1:10 on a weight basis have been established for the dissolution of high volatile Bituminous "A" coal containing 1.33% S in an MCB stream containing 1.09% S when the solvent-to-coal ratio in the coal dissolution step is 0.67. More sulfur scavenger would be required when the organic sulfur content of materials contained in the reactor-dissolver 7 are higher.

Preferably, the design configuration of reactor-dissolver 7 is continuous-flow stirred tank; and the coal dissolution process is conducted at a temperature of 600° to 850° F, a pressure in the range of 0 to 700 psig, a residence time in the range of 0.1 to 2.0 hours, and a Fe-to-organic sulfur weight ratio in the range of 2 to 10.

After coal dissolution, materials introduced into the reactor-dissolver 7 are withdrawn in the form of a slurry, through line 8 and passed to the slurry settler 30. In addition to the slurry, an overhead stream composed primarily of a fuel gas mix is withdrawn from reactor-dissolver 7 and passed through line 9 to the gas plant desulfurization zone 95. Depending upon the reaction conditions within the reactor-dissolver 7, the fuel gas mix may contain water, carbon monoxide, carbon dioxide, nitrogen, and hydrogen sulfide. Desulfurization by the iron sulfur scavenger in the reactor-dissolver 7 is highly efficient for removing sulfur from hydrocarbonaceous moieties of coal and the MCB solvent. In fact, the affinity of the iron scavenger for sulfur is so strong that in the example (set forth below) no gaseous hydrogen sulfide was evolved, thereby conserving hydrogen and also eliminating the need to process the overhead gas stream to remove sulfur prior to its use as fuel.

The gas plant desulfurization zone 95 may be any of the $H_2S$ scrubbing systems known in the art. For example, diethanolamine may be employed in a gas absorption tower to desulfurize the fuel gas mix. Hydrogen sulfide may be recovered from the spent diethanolamine, and the regenerated diethanolamine may be recycled to the absorption tower.

The slurry passing from reactor-dissolver 7 through line 8 contains desulfurized MCB, dissolved coal, FCC catalyst fines, coal ash, undissolved coal, excess Fe sulfur scavenger, and converted Fe sulfur-scavenger in the form of particulate, filterable, inorganic compounds of iron with sulfur, i.e., pyrites: FeS, $Fe_2S_3$, $Fe_xS_y$, etc. The slurry may be mixed with hot light cycle oil (LCO) introduced via line 20 and the mixture is then passed to the slurry settler 30. Introduction of hot LCO is desirable as it facilitates coagulation and settling of fines, coal-derived inorganics, etc. The hot LCO may be obtained from either the main column 15 via line 17 or from the vacuum tower 40 via line 45. The latter stream is first heated in heat exchanger 47 before being recycled. A typical LCO stream has the following properties:

| | Torrance FCC LCO |
|---|---|
| Boiling Point distribution, wt.% | |
| 420° F− | 4.8 |
| 420–650° F | 87.9 |
| 650–800° F | 7.3 |
| 800–1000° F | — |
| 1000° F+ | — |
| H, wt.% | 10.64 |
| S, wt.% | 1.01 |
| N, wt.% | 0.24 |
| Ni+V, PPM | — |
| CCR, wt.% | — |
| Paraffins, wt.% | 12.7 |
| Mononaphthenes, wt.% | 11.7 |
| Polynaphthenes, wt.% | 12.8 |
| Monoaromatics, wt.% | 24.7 |
| Diaromatics, wt.% | 21.7 |
| Polyaromatics, wt.% | 14.3 |
| Aromatic sulfur type, wt.% | 2.1 |
| Identification | — |

It is also desirable to introduce cooled heavy cycle oil (HCO) via line 23 into the slurry settler 30. The cooled HCO may be obtained either from the main column 15 via line 18 or from the vacuum tower 40 via lines 42 and 44. Hot HCO from the vacuum tower 40 passes in heat exchange relationship with vacuum tower LCO (line 41) in heat exchanger 47 before being recycled. A typical HCO stream has the following properties:

| Heavy Cycle Oil | |
|---|---|
| Sulfur | 1.12% |
| Nitrogen | 420 ppm |
| 5% Boiling Point | 450° F |
| 95% Point | 752° F |
| Conradson Carbon | 0.15 |

Slurry settler 30 is a clarifier having the primary purpose of partitioning the slurry from the reactor-dissolver 7 into hot, low-sulfur hydrocarbonaceous coal-oil materials which are withdrawn overhead via line 31 and partially-coagulated ash, pyrite, iron oxides, iron sulfides, FCC catalyst fines, and other dense matter which are withdrawn as bottoms via line 32. If design conditions of the processes permit, slurry settler 30 may be the same one used in the FCC complex 10; the settler could be run in blocked-out operation if suitable storage capacity were available.

It is essential to the successful operation of the slurry settler that there be near-laminar flow and minimum turbulence in the area where the coal slurry enters the settler — i.e., at the level where line 21 enters slurry settler 30. Moreover, the specific gravity difference between the cold HCO entering the settler via line 23 and the hot slurry of coal plus solvent entering via line 21 is critical: the bigger the difference, the more effective will be the separation between the liquid layers.

The cold HCO entering the settler cone via line 23 should be at least 0.05 specific gravity units greater than the specific gravity of the hot slurry of coal plus solvent. Preferably, the difference is 0.1 specific gravity units or more. Control of the difference is achieved by control of the temperature of the HCO. For example, the temperature of the HCO must be reduced to less than 200° F (preferably to less than 150° F) to have greater specific gravity than that of the hot coal-oil slurry which may enter the settler at a temperature of about 650° to 750° F.

The diameter of the slurry settler 30 is a function of both: (1) the particle size and the particle size distribution of the particulate solids present in the settler and (2) the feed rates. Additionally, linear velocities and residence times must be regulated via hardware design so that solids have adequate time to settle out into the bottoms portion of the settler removed via line 32. Particle size, particle size distribution (and hence average particle size), and the particle settling characteristics are dependent on the ash concentration and characteristics of the original coal feed, the $Fe/Fe_2O_3$ (or other sulfur scavenger) source, the FCC catalyst fines concentration and characteristics, and the depth of extraction achieved in the coal dissolution step (i.e., the amount of undissolved coal solids and their state of aggregation). Settler diameter must be large if particle size distribution is skewed toward the smaller sizes; the diameter may be smaller if the particles are larger and hence tend to settle more rapidly.

Figure 2:
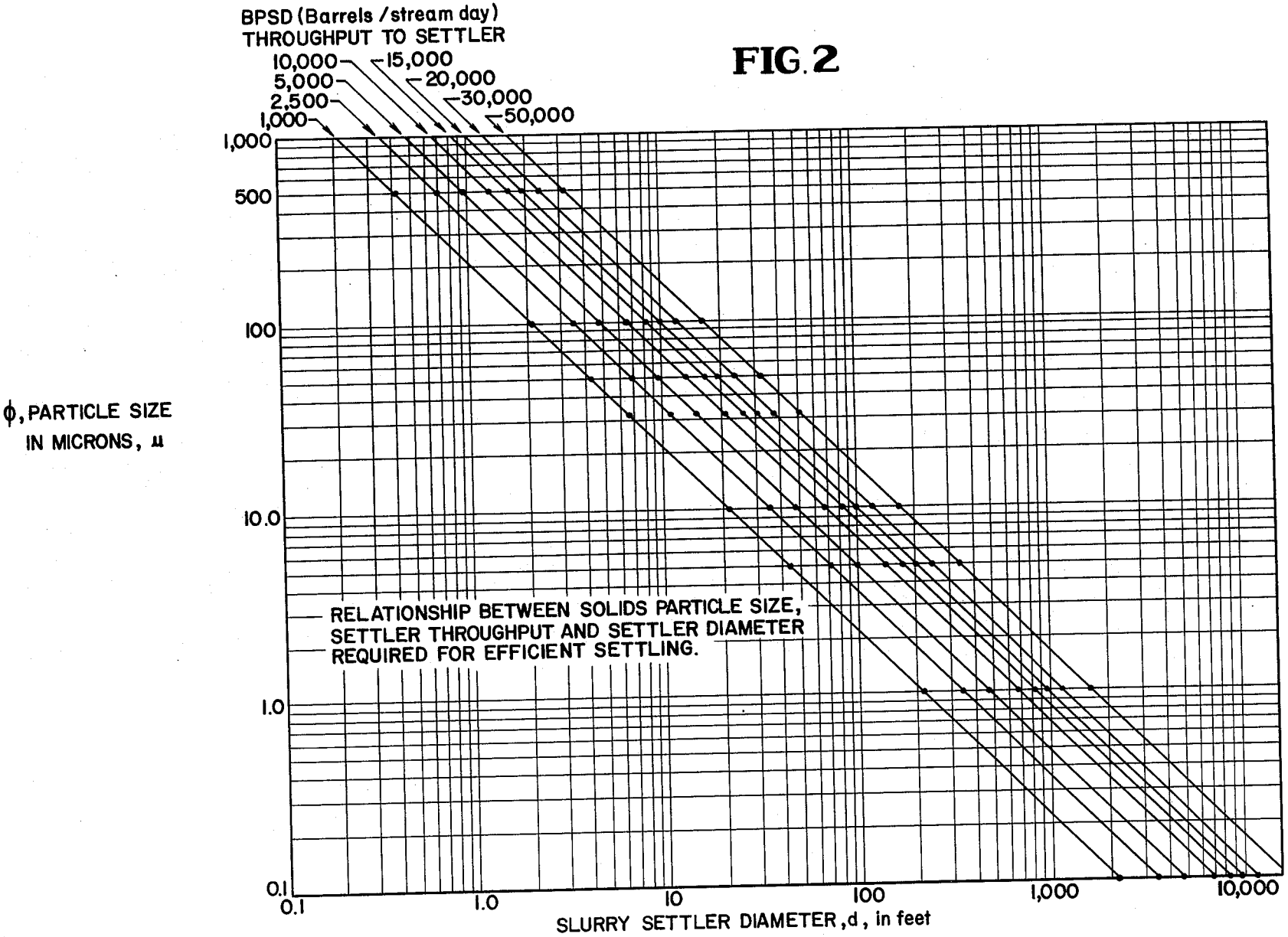
FIG. 2 is a plot of the relationship between solids particle size, settler through-put, and settler diameters which are required to effect efficient settling in the slurry settler of this invention.

As an example of the particle sizes that can be expected, the diameters of "inorganic ash" in coal (including pyrite, etc.) could range from 1 to 100 microns and higher; FCC catalyst fines diameters could range from 10 to 100 microns in size and average near 70 microns (of course, the ranges vary with the particular catalyst employed in the FCC process); $Fe_2O_3$ or other metal oxide sulfur scavenger particle size diameters will vary substantially depending upon the source and the degree of grinding and classification prior to its use in the coal dissolution step, and the method of regenerating the spent scavenger; and the diameters of undissolved or re-aggregated coal particles will vary considerably depending primarily on the source of the coal, the nature of coal preparation and the severity of the coal dissolution step. Because of the substantial variance in particle diameters, it is difficult to state general rules regarding the design configuration of the slurry settler. Accordingly, reference should be had to FIG. 2 which indicates the diameter of the slurry settler required to obtain practical and efficient settling times for a wide range of average particle sizes and slurry settler flow rates. Use of this figure together with information on the parameters of the specific process under consideration will enable those skilled in the art to practice the present invention. Generally, widths in the range of from 10 to 300 feet are preferred.

With respect to the sidewall height of said slurry settler, a height of 30 feet may be considered typical, but this is a guideline only and not restrictive. The sidewall height is of secondary importance and should mereby be high enough to allow any turbulence engendered by the various inlet streams to be dissipated before removal of the high- and low-solids streams.

In addition to the foregoing slurry settler operation, it will often be desirable to inject some large particles (preferably in the range of 50 to 100 microns) into the slurry settler at a level above the introduction of the slurry from the dissolver-reactor 7. By employing this aspect of the invention in the slurry settler operation, the falling "large particles" will collide with rising smaller particles from the coal dissolution slurry, causing the smaller particles to lose some of their energy and velocity and thus facilitate solids separation. A useful mode of the present aspect is to inject large particles of Fe or Fe-oxides from the iron preparation zone 90 into the slurry settler 30 via line 93. Means which may be employed in the iron preparation zone 90 to effect separation of larger sulfur scavenger particles include a simple air elutriation step or other solids/solids classification steps known in the art. Essentially, the largest, iron, sulfur-scavenger material acts as a nucleating agent to help aggregate and precipitate the finer solids from the coal dissolution slurry. The degree to which this aspect of the invention is employed will depend upon the specifications of the coke product withdrawn from the coker 50 through line 55. Complete removal of all suspended solids from the overflow 31 from the slurry settler is not possible and, since most of the solids carried over to the overflow 31 will eventually be removed from the system in the coke product 53, the ash specification of the product coke is limiting in terms of determining the amount of solids carry-over from the slurry settler which can be tolerated. Alternatively, if the ash specification of the product coke allow, it may be desirable to intentionally sacrifice coal dissolution slurry solids to the coke, which would allow smaller settler diameters, shorter settler residence times, and lower heat exchange requirements.

The clarified overhead from the slurry settler 30 is passed through line 31 (which may incorporate a preheater operation) to the vacuum tower 40 where the clarified slurry is vacuum distilled to produce the following fractions:

(1) vacuum tower light cycle oil (LCO) overhead which is withdrawn from the tower via line 41 and recycled to the slurry settler via lines 45 and 20 after being heated in heat exchanger 47 by vacuum tower HCO;

(2) vacuum tower heavy cycle oil (HCO) side-draw which is withdrawn via line 42 and either recovered as a product or cooled in heat exchanger 47 and recycled;

(3) vacuum tower heavy oil side-draw which is withdrawn via line 43 and either recovered as a low-sulfur fuel product or recycled to reactor-dissolver 7 through furnace 38, to provide heat for the dissolution process, and (4) low-sulfur, solvent refined coal which is withdrawn via line 46 as the bottoms fraction of the vacuum tower 40.

The vacuum bottoms withdrawn from vacuum tower 40 through line 46, hereinafter referred to as solvent refined coal, may be cooled and used as low-sulfur fuel for turbines, boilers, etc., or for asphalt manufacture. Cutter stocks may be employed as needed to meet specifications for #6 fuel oil and similar products.

Cutter stocks are preferably light hydrocarbon oils boiling in the range between about 300° F and 650° F. The hydrocarbon components of the solvent mixture generally will be cyclic and alicyclic compounds containing between 8 and about 20 carbon atoms. A particularly preferred type of light hydrocarbon blending solvent is a light cycle stock derived from TCC and FCC cracking refinery operations. Illustrative of suitable refinery cutter-stock solvents are FCC light cycle stock (420° F–650° F, $C_{12}$–$C_{20}$), and the like.

Alternatively, the solvent refined coal withdrawn through line 46 may be heated in furnace 48 and passed through line 49 to coker 50, where low-sulfur liquid fuels and a high-grade, low-ash, low-sulfur coke suitable for fuels or metallurgical use are produced and withdrawn through lines 53 and 55 respectively. The fluid coker effluent passes through line 53 to coker fractionator tower 60, an atmospheric distillation tower which separates the fluid coker effluent into the following fractions:

(1) an overhead gas stream withdrawn from the tower through line 61;
(2) a low-quality gasoline having a low-sulfur content withdrawn through line 63;
(3) a light fuel oil (LFO) withdrawn through line 65;
(4) a heavy fuel oil (HFO) withdrawn through line 66, and
(5) a heavy oil withdrawn as a bottoms fraction through line 67.

The coker fractionator tower overhead gas may be further treated in the gas plant desulfurization zone 95; the three intermediate fractions are low-quality gasoline and fuel oil which, because of their low sulfur content, are adequate fuel products; and coker fractionator tower heavy oil is either recycled to the coker 50 via line 69 or passed through line 68 to combine with vacuum tower heavy oil for recycle to reactor dissolver 7.

The advantage of employing a coking operation in the process of the invention is that it provides a carbon-rejection pathway if liquid fuels are desired. As previously mentioned, a further advantage of the coking process is that it presents an economical way of removing solids carried over from the slurry settler, provided that the ash specifications of the product coke are maintained. Although the coking operation of this preferred embodiment follows a vacuum distillation step, it may be advantageous to modify the process configuration so that the overflow from the slurry settler is introduced directly into a coker. Such a modification, while not preferred, is also within the scope of this invention.

The slurry settler bottoms are passed from the settler 30 via line 32 to separator 70 where separation means such as filtration, centrifugation, multicloning, etc., recover coal dissolution product carried with the settled solids from the settler. If a filter is used as the separation means, the filtered residue is washed with vacuum tower HCO entering the separator via line 24. Steam stripping of the filtered residue may also be desirable, depending on the heat requirements of the regenerative gasifier 80. Recovered coal dissolution product passes from separator 70 through line 72 and combines with the clarified slurry settler overflow passing through line 31 to vacuum tower 40.

Separated solids from the separator 70 are passed through line 74 to regenerative gasifier 80. The separated solids include FCC catalyst fines, excess Fe or Fe-oxide sulfur scavenger, spent Fe or Fe-oxide sulfur scavenger consisting of inorganic compounds of iron and sulfur (i.e., FeS, $Fe_2S_3$, $Fe_xS_y$, etc.), coal ash, undissolved or re-aggregated coal particles, etc. In the gasifier, upon admission of steam introduced via line 78 and air or an oxygen-containing gas introduced via line 76, partial oxidation of the residual hydrocarbonaceous material occurs, producing a sulfur-rich, low BTU gas which is sent via line 82 to the gas plant desulfurization zone 95 and a regenerated iron-containing solid which is sent via line 84 to the sulfur scavenger separator 85. The use of a regenerative gasifier is described more fully in U.S. Pat. No. 3,983,030, hereby incorporated by reference.

Ash solids are removed from the iron sulfur scavenger in separator 85 by means suitable to the sulfur scavenger employed. In a preferred embodiment, a magnetic separation means is desirable. The recovered iron sulfur scavenger passes from the separator 85 via line 87 where it may be combined with iron sulfur scavenger make-up entering the process via line 88.

Recycled and make-up iron sulfur scavenger enter the iron preparation zone 90. Iron preparation is essentially a classification according to size with the objective of returning finely-divided, iron sulfur scavenger to the reactor-dissolver 7 through line 4 and, as previously described, sending iron sulfur scavenger having a larger particle size to slurry settler 30 through line 93. Preferably, the classification means is an air elutriation system. It is desirable that the iron sulfur scavenger returned to the reactor-dissolver 7 be finely-divided so that more sulfur scavenger surface area is available for sulfur capture and, further, that the scavenger may be better dispersed in the coal dissolution slurry. It may also be desirable to reject a portion of the iron sulfur scavenger from the iron preparation zone 90 via line 91.

EXAMPLE

Pulverized high volatile Bituminous "A" coal (60 gm) was mixed with FCC main column bottoms (90 gm, 10° API) and powdered iron oxide, $Fe_2O_3$ (6 gm having an average particle size of 75 microns). The mixture was heated at autogenous pressures in a closed autoclave for one hour at 750° F with mechanical stirring and without any added hydrogen. After cooling, the gasiform product was vented, collected and analyzed. A unifrom, dark-colored, highly viscous fluid was recovered from the reactor. Total recovery was over 95 percent. After workup, which included a series of selective extractions, precipitations, and filtrations, the following approximate component break-down was obtained:

| Component | Wt. % (a) |
|---|---|
| Ash | 4.9 |
| Pyridine-insoluble | 4.0 |
| Benzene-insoluble | 31.6 |
| Benzene-soluble/hexane-insoluble | 7.5 |
| Gas | 1.1 |
| Water | 0.9 |
| Hexane-soluble | 50.0 |
| | 100.0 |

(a) No loss basis

For purposes of comparison, a control run was also performed under the same conditions as described for the iron oxide run. As the following sulfur analysis indicates, a substantial further sulfur reduction occurred in the iron oxide run.

| Product | Sulfur Analysis, Wt. % | | % Decrease in Sulfur Over Control |
|---|---|---|---|
| | Control Run | Iron Oxide Run | |
| Benzene-insoluble | 0.73 | 0.53 | 27.4 |
| Benzene-insoluble/ Hexane-insoluble | 0.98 | 0.65 | 33.7 |

Not only was there sulfur reduction in the liquid-solid coal-derived products shown above, but there was also complete removal of sulfur (i.e., no hydrogen sulfide)

from the gaseous products as shown in the following analysis of the gasiform products.

TABLE 3

| Gaseous Product | Wt. % Product | |
|---|---|---|
| | Control Run | Iron Oxide Run |
| Hydrogen | 0.4 | 1.4 |
| Methane | 21.7 | 31.9 |
| Ethane | 13.7 | 19.7 |
| Propene | 1.9 | 0.0 |
| Propane | 9.1 | 11.2 |
| iso-Butane | 3.4 | 3.1 |
| Butenes | 1.3 | 2.2 |
| n-Butane | 3.6 | 4.8 |
| iso-Pentane | 1.5 | 4.4 |
| Pentenes | 1.0 | 1.6 |
| n-Pentane | 0.0 | 1.0 |
| Hexenes | 0.8 | 0.5 |
| Hexanes | 5.0 | 0.0 |
| Hydrogen Sulfide | 13.9 | 0.0 |
| Carbon Monoxide | 2.1 | 1.5 |
| Carbon Dioxide | 20.6 | 16.7 |
| | 100.0 | 100.0 |

The gases co-produced from these coal dissolution experiments show gross heats of combustion of ~1120–1250 BTU/SCF, and hence constitute useful fuel gas streams, with the gas from the iron oxide run constituting a sulfur-free fuel gas.

The foregoing indicates the effectiveness of sulfur removal attained by employing a solid sulfur scavenger, particularly an iron sulfur scavenger, in the coal dissolution step of solvent refining processes for converting coal to clean fuel products. As previously described, the sulfur scavenger is also useful in the subsequent separation of solid particulate matter in the slurry settler of this invention, the slurry settler being a sophisticated decantation operation wherein the separation is also facilitated by the strategic use of solvents of various boiling ranges. A further advantage of the iron sulfur scavenger is that it may have a catalytic role in promoting hydrogen transfer needed for coal dissolution in the coal liquefaction phase of this invention. Finally, combining the above operations with vacuum distillation, heat-exchange, coking, regenerative gasification, and magnetic separation will efficiently and economically generate low-oxygen, low-sulfur, low-metals, low-ash, hydrocarbonaceous compositions suitable for a wide variety of fuels applications, including conventional petroleum-type distillates such as No. 5 or No. 6 fuel oils, turbine oils, boiler fuels, etc., plus a small but significant stream of sulfur-free, high-BTU (about 1100 to 1250 (BTU/SCF) fuel gas. Depending upon the specific details of the combination, the process affords great flexibility in selecting the ratio of light fuel oils: heavy fuel oils: semi-liquid materials: solid, coke-like fuels. The fact that low-sulfur, low-ash, low-metals coke can be generated affords a means of carbon rejection, thus obviating the need to add hydrogen to meet the specifications of premium fuel products.

What is claimed is:

1. An improved solvent refining process for converting coal to clean fuel products without added hydrogen which comprises:

a. contacting finely divided coal with a coal liquefaction solvent in the presence of a solid sulfur scavenger selected from the group consisting of metals, metal oxides, metal salts, and mixtures thereof, said sulfur scavenger being capable of conversion to an insoluble sulfide or sulfur complex, at a temperature sufficient to effect coal dissolution and thereby produce (1) a gas phase and (2) a liquid phase comprising a mixture of coal extract, liquefaction solvent, sulfur scavenger and undissolved residue;

b. effecting separation of said liquid phase mixture by clarifier settling means to produce (1) a clarified settler overflow containing coal extract and coal liquefaction solvent and (2) a solids-rich settler underflow; and c. thereafter recovering from said overflow a fuel product of reduced sulfur content.

2. The process of claim 1 wherein the solid sulfur scavenger is a member selected from the group consisting of iron and iron oxides.

3. The process of claim 2 wherein a cooled heavy cycle oil is added to the clarifier settling means and a heated light cycle oil is added to the liquid phase mixture prior to introduction thereof into said settling means, the specific gravity of the heavy cycle oil entering the settling means being at least 0.05 units greater than the specific gravity of the light cycle oil.

4. The process of claim 3 wherein the coal liquefaction solvent is a thermally stable, highly aromatic petroleum refinery fraction.

5. The method of claim 4 wherein large particles of the sulfur scavenger are added to the clarifier settling means as a nucleating agent to help aggregate and precipitate fine solids.

6. In a refining process for converting coal to clean fuel products, the improvement which comprises:

a. contacting finely divided coal with a coal liquefaction solvent in the absence of added hydrogen and in the presence of a solid sulfur scavenger selected from the group consisting of metals, metal oxides, metal salts, and mixtures thereof, said sulfur scavenger being capable of conversion to an insoluble sulfide or sulfur complex at a temperature sufficient to effect coal dissolution and thereby produce (1) a gas phase and (2) a liquid phase comprising a mixture of coal extract, liquefaction solvent, sulfur scavenger and undissolved carbonaceous residue; and, b. introducing said liquid phase and a heated light cycle oil into a clarifier settling zone;

c. introducing into said clarifier settling zone a cooled heavy cycle oil having a specific gravity of at least 0.05 units greater than the specific gravity of the liquid phase-heated light cycle oil mixture;

d. effecting separation of said liquid phase in the clarified settling zone to produce (1) a clarified settler overhead fraction comprising coal extract and coal liquefaction solvent; and (2) a solids rich settler bottoms fraction;

e. introducing said clarified overhead fraction into a distillation zone and thereafter recovering:

(1) a light cycle oil overhead fraction, (2) a low-sulfur, solvent refined coal bottoms fraction, (3) a heavy cycle oil, and (4) a heavy oil low-sulfur fuel product.

7. The method of claim 6 wherein the settling zone is circular and the diameter thereof is in relationship to the average particle size of solids present therein and the through-put of the liquid phase introduced thereto, said relationship being defined according to the graph set forth in FIG. 2.

8. The method of claim 6 wherein the sulfur scavenger is separated from the solids rich settler bottoms fraction and is regenerated in the presence of steam and an oxygen-containing gas.

9. The method of claim 6 wherein said gas phase is separated from the liquid phase and is desulfurized to provide fuel gas of low-sulfur content.

10. The method of claim 6 wherein at least a portion of said low-sulfur solvent refined coal is subjected to coking to provide low-sulfur liquid fuels and a high grade, low-sulfur coke product.

* * * * *

UNITED STATES PATENT AND TRADEMARK OFFICE

CERTIFICATE OF CORRECTION

PATENT NO. : 4,077,866

DATED : March 7, 1978

INVENTOR(S) : HARTLEY OWEN, PAUL B. VENUTO and TSOUNG-YUAN YAN

It is certified that error appears in the above-identified patent and that said Letters Patent are hereby corrected as shown below:

Column 14, lines 63 & 64 "Benzene-insoluble/ Hexane-insoluble" should be --Benzene-soluble/ Hexane-insoluble--.

Column 15, Table 3 Under heading "Gaseous Product" should be:

| | |
|---|---|
| "iso-Butane | --iso-Butane |
| n-Butane | n-Butane |
| iso-Pentane | iso-Pentane |
| n-Pentane" | n-Pentane--. |

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*